US008876165B1

(12) United States Patent
Maggi

(10) Patent No.: US 8,876,165 B1
(45) Date of Patent: Nov. 4, 2014

(54) CLIPBOARD WITH MOUNTING ACCESSORIES

(71) Applicant: Hege Innovations, Inc., Miami, FL (US)

(72) Inventor: George Albert Maggi, Miami, FL (US)

( * ) Notice: Subject to any disclaimer, the term of this patent is extended or adjusted under 35 U.S.C. 154(b) by 18 days.

(21) Appl. No.: 13/891,936

(22) Filed: May 10, 2013

(51) Int. Cl.
*B42F 9/00* (2006.01)

(52) U.S. Cl.
CPC ..... *B42F 9/002* (2013.01)
USPC ..... 281/45; 24/67.5; 24/67.7; D19/88

(58) Field of Classification Search
CPC ..... B42F 9/001
USPC ..... 281/44, 45; 24/67.5, 67.7; D19/88
See application file for complete search history.

(56) References Cited

U.S. PATENT DOCUMENTS

| | | | | |
|---|---|---|---|---|
| 4,419,794 | A | 12/1983 | Horton, Jr. et al. | |
| D273,002 | S | 3/1984 | Schafer | |
| 4,718,586 | A | 1/1988 | Hagino | |
| D296,156 | S | 6/1988 | Deany et al. | |
| D301,489 | S | 6/1989 | Aquila et al. | |
| D318,608 | S | 7/1991 | Schenker | |
| 5,116,012 | A * | 5/1992 | Offenhauer et al. | 281/45 |
| D332,114 | S * | 12/1992 | Offenhauer et al. | D19/88 |
| 5,413,382 | A * | 5/1995 | Cornell et al. | 281/45 |
| 5,597,102 | A | 1/1997 | Saarikko et al. | |
| 5,850,996 | A | 12/1998 | Liang | |
| 6,520,863 | B2 | 2/2003 | Porper | |
| 6,578,745 | B1 | 6/2003 | Taylor et al. | |
| 6,681,452 | B1 * | 1/2004 | Holland | 24/67.7 |
| D495,369 | S * | 8/2004 | Holland | D19/88 |
| 6,786,372 | B2 | 9/2004 | Enkerlin et al. | |
| 6,905,051 | B2 | 6/2005 | Chee | |
| 7,832,606 | B2 | 11/2010 | Sin | |
| 2003/0102341 | A1 | 6/2003 | Iitsuka | |
| 2008/0237282 | A1 | 10/2008 | Sin | |
| 2010/0219312 | A1 | 9/2010 | Johnson et al. | |

FOREIGN PATENT DOCUMENTS

| | | | |
|---|---|---|---|
| GB | 2276348 | A | 9/1994 |

* cited by examiner

*Primary Examiner* — Kyle Grabowski
(74) *Attorney, Agent, or Firm* — Albert Bordas, P.A.

(57) ABSTRACT

A clipboard having a board assembly with a front face and a rear face. A clip assembly is mounted onto the board assembly. The board assembly docks onto a docking assembly. The front face is defined by a top edge, a bottom edge, and first and second lateral edges. The rear face has first and second lower interior channel guide edges and first and second higher interior channel guide edges. The board assembly tapers from the top edge towards the bottom edge. The first and second higher interior channel guide edges terminate forming a channel neck. The channel neck is a channel to receive the docking assembly. The rear face further has at least one grip section that extends from the first or second lateral edge. The front face has a recessed face, and the clip assembly has a docking station, a spring assembly, and a writing instrument holder.

17 Claims, 6 Drawing Sheets

CLIPBOARD WITH MOUNTING ACCESSORIES

BACKGROUND OF THE INVENTION

1. Field of the Invention

The present invention relates to clipboards, and more particularly, to a clipboard with mounting accessories.

2. Description of the Related Art

Applicant believes that one of the closest references corresponds to U.S. Patent Application Publication No. 20100219312 A1, published on Sep. 2, 2010 to Johnson, et al. for Item Holder. However, it differs from the present invention because Johnson, et al. teaches an item holder that includes a hanger and a holder. The hanger includes a hanger body, a protrusion and one or more apertures. The holder includes a holder body, a receiving slot, a securing mechanism, tabs, a holder member and an end-piece. The holder is configured to detachably couple to the hanger. In some embodiments, the securing mechanism includes fingers/wedges, which secure the protrusion in place and are released using the tabs. The holder, specifically the holder member, is also configured to hold an item.

Applicant believes that another reference corresponds to U.S. Patent Application Publication No. 20030102341 A1, published on Jun. 5, 2003 to Iitsuka for a mechanism for engaging portable equipment against a belt clip. However, it differs from the present invention because Iitsuka teaches an engaging mechanism of a system in which the flange-like protrusion at the portable equipment is engaged with or locked to an engaging part at a belt clip, wherein both fitting and removing for the portable equipment are simplified. The system such that the flange at the portable equipment is constituted by the disc and the annular frame, the protrusion directed inwardly from the annular frame with its circumferential sides being applied as slant surfaces; the engaging plate of the belt clip is provided with the engaging part comprised of the frame and the front plate formed with the U-shaped recess, the engaging plate is constituted by the cantilever beam defined by the slit, the extremity end of the beam is formed with the claw with its upper side being applied as the slant surface; when the flange is fitted into the engaging part, the claw is fitted inside the annular frame to apply a locked state, and when the portable equipment is turned by 180 degree, the protrusion causes the claw to be retracted and releases the locked state.

Applicant believes that another reference corresponds to U.S. Pat. No. 7,832,606 B2 (and Patent Application Publication No. 20080237282 A1, published on Oct. 2, 2008), issued to Sin on Nov. 16, 2010 for a belt clip for detachably fixing cellular phone. However, it differs from the present invention because Sin teaches a belt clip for detachably fixing a cellular phone, which comprises a body which has an accommodating part provided in the interior of the same and having an opened upper side, and a guide groove provided at a front side of the same for guiding accommodating into the accommodating part; and at least one stopper which is integrally formed at an inner side of the body and has a certain elastic force for preventing an escape of the accommodated engaging protrusion. It is possible to engage and disengage the cellular phone or the cellular phone casing to/from the belt clip, and the construction is simple. Springs are not used, and a belt clip for cellular phone can be manufactured.

Applicant believes that another reference corresponds to U.S. Pat. No. 6,905,051 B2 issued to Chee on Jun. 14, 2005 for a protective case for use with a belt. However, it differs from the present invention because Chee teaches a protective case that may be used with or without a belt clip. A recess is formed in the inside surface of rear panel of the case, with a corresponding slight, smooth bubble formed on the outside surface of the rear panel. The bubble of the recess has a through-bore. A nut is embedded into the recess and held in place by a backing affixed to the inside surface of the rear panel. A threaded post with a head may be threaded into the nut in the recess. The case is then easily captured in the belt clip by sliding the post into a groove on the clip. If the user desires to use the protective case without the belt clip, the post is easily removed from the rear panel, leaving only the slightly raised, smooth bubble.

Applicant believes that another reference corresponds to U.S. Pat. No. 6,786,372 B2 issued to Enkerlin, et al. on Sep. 7, 2004 for a belt clip apparatus for portable electronic device. However, it differs from the present invention because Enkerlin, et al. teaches a belt clip apparatus for releasably holding a portable device on a user's apparel having a base member with a latch opening for receiving a lock pin projecting from the portable device, a clip for securing the base member to the wearer's apparel, and a latch member movably mounted in the base member for movement between a first position locking the lock pin in the latch opening, and a released position permitting the lock pin to be removed from the latch opening. A manually operable actuator linked to the latch member can be actuated by a user to move the latch member between the locked and released positions. The actuator is moved in a generally horizontal direction transverse to the hanging direction in order to release the latch member. A biasing device biases the latch member towards the locked position.

Applicant believes that another reference corresponds to U.S. Pat. No. 6,578,745 B1 issued to Taylor, et al. on Jun. 17, 2003 for a removable belt clip. However, it differs from the present invention because Taylor, et al. teaches an attachment device for attaching an implement, such as a knife, pager, telephone or the like onto a belt or other garment. The device includes a clip assembly for attachment to the belt, and includes a slot having an end portion circular in shape with a radius larger than the width of the slot. A pin fits into the slot only when at least one flat surface on the neck portion of the pin is parallel to one edge of the slot. The pin is allowed to rotate via the circular shape and the pin having a stem diameter corresponding the circular shape. This provides a locking mechanism where the narrower width of the slot prevents the pin from exiting the slot unless the instrument is turned a specific angle.

Applicant believes that another reference corresponds to U.S. Pat. No. 6,520,863 B2 issued to Porper on Feb. 18, 2003 for a billiards chalk assembly. However, it differs from the present invention because Porper teaches a billiards chalk assembly including a clip, a billiards chalk holder releasably attached to the clip, and billiards chalk insertable into the holder. The clip includes a base having a retention slot formed thereon for securing the billiard chalk holder. A plate is pivotally attached to the base opposite the chalk holder. A spring is interposed between the base and the plate to maintain the plate in a biased closed position. The retention slot is defined by a lip extending inwardly from a lower edge of the base and forming a groove and an open-faced slot. The chalk holder includes an extension having a post, which is insertable into the open-faced slot, and an outwardly extending ridge, which is insertable into the groove of the retention slot. A locking mechanism is engageable with the chalk holder and releasably locks the chalk holder in place.

Applicant believes that another reference corresponds to U.S. Pat. No. 5,850,996 B1 issued to Liang on Dec. 22, 1998 for a mobile telephone hanging device. However, it differs from the present invention because Liang teaches a mobile telephone hanging device which includes a base plate, a clamping plate hinged to the base plate for fastening it to the user's belt, a hanging plate fixedly secured to the mobile telephone and having a grooved hanging rod for fastening to the base plate, the base plate having a smoothly curved rib for hanging the hanging rod of the hanging plate and an elongated movable plate for stopping the hanging rod of the hanging plate in the engaged position, and two push rods controlled to release the elongated movable plate from the hanging rod of the hanging plate for permitting the hanging plate to be disconnected from the base plate.

Applicant believes that another reference corresponds to U.S. Pat. No. 5,597,102 B1 issued to Saarikko, et al. on Jan. 28, 1997 for an attachment device for a mobile station. However, it differs from the present invention because Saarikko, et al. teaches a device to be used with a mobile station, comprising a body to be attached e.g. to a belt with an attachment plate and a fastener attached to the mobile station with a fitting piece. The body includes control flanges bent inward from two opposite sides and from below to guide the fastener, which comprises a neck and a wider end consisting of a flange placed behind the guide flanges. The body also includes a projection or a similar structure acting against a spring force, resisting the upward movement of the fastener when said fastener is in the locked position.

Applicant believes that another reference corresponds to U.S. Pat. No. 4,718,586 B1 issued to Hagino on Jan. 12, 1988 for a swivel fastening device. However, it differs from the present invention because Hagino teaches a swivel fastening device for removably connecting two objects together in such manner that, once the connection is made, the objects may swivel with respect to one another to a considerable degree without detachment from one another; a swivel attachment involving a belt carried element which is removably engageable with a case carrying element, the case carrying element engageable and disengageable with the belt carrying element only when the case is in a vertical, inverted position, all other engaged positions retaining a solid interconnection between the belt element and the case element; a case element having an enlarged headed post and two spaced apart pins thereon engageable with two channels in a belt carried element operable to provide a swivel attachment effective over a large arcuate angle.

Applicant believes that another reference corresponds to U.S. Pat. No. 4,419,794 B1 issued to Horton, Jr., et al. on Dec. 13, 1983 for a portable fastening device. However, it differs from the present invention because Horton, Jr., et al. teaches a portable two-part fastening device having a female section including a keyhole, a spring within the female section, and a ridge supported by the spring, an open channel in the female section contiguous with the narrow dimension of the keyhole, and means for mounting the female section to one part of the device. A male section comprises a button larger than the keyhole but having a width less than the open channel, with a flattened stud connecting said button to the other part of the two devices. The button has an indentation on the outer face thereof of a geometrical configuration so as to mate with the ridge on the spring. The narrow dimension of the stud has a width less than the narrow dimension of the keyhole whereby the button and the stud may be positioned such that the button passes through the open slot and the stud passes through the narrow dimension of the keyhole with the spring exerting a biasing force against the face of the button hole so that the button and stud are maintained within the female portion.

Applicant believes that other references correspond to U.S. Design Pat. Nos. D318608 B1 issued to Schenker on Jul. 30, 1991 for a fastening clip for planks, clipboards, or the like; U.S. Pat. No. D301489 B1 issued to Aquila, et al. on Jun. 6, 1989 for a clipboard for shopping cart push bar; U.S. Pat. No. D296156 B1 issued to Deany, et al. on Jun. 14, 1988 for a golf ball marker holder; and U.S. Pat. No. D273002 B1 issued to Schafer on Mar. 13, 1984 for a note clipboard for an automobile visor.

Applicant believes that another reference corresponds to GB Patent No. 2276348 issued to Starling on Sep. 28, 1994 for a bracket-mounted clipboard. However, it differs from the present invention because Starling teaches a clipboard comprising a body having a socket and a separable mounting bracket having two tongues of different length, each of which tongues is complementary to the socket. When the shorter tongue is engaged in the socket the bracket is adapted to be mounted to a shopping trolley (i.e. either with the edge rail of the basket engaged between lugs and the longer tongue, and with the longer tongue itself resting on the inner surface of the basket to stabilize the clipboard against tilting; or with the tongue engaged with a dedicated complementary formation on the trolley). When the longer tongue is engaged with the socket the bracket is adapted to cooperate with a complementary further bracket, which may be secured to a wall by adhesive. In this configuration the lugs may serve as a pencil holder. An embodiment is shown in which the tongued bracket is provided with a cord loop whereby the clipboard may be worn round the neck of a user.

Other patents describing the closest subject matter provide for a number of more or less complicated features that fail to solve the problem in an efficient and economical way. None of these patents suggest the novel features of the present invention.

SUMMARY OF THE INVENTION

The instant invention is a clipboard comprising a board assembly having a front face and a rear face. A clip assembly is mounted onto the board assembly. The instant invention also comprises docking means to dock the board assembly onto a docking assembly.

The front face is defined by a top edge, a bottom edge, and first and second lateral edges. The rear face comprises first and second lower interior channel guide edges and first and second higher interior channel guide edges. The board assembly tapers from the top edge towards the bottom edge. The first and second higher interior channel guide edges terminate forming a channel neck. The channel neck is a channel to receive the docking assembly. The rear face further comprises at least one grip section that extends from the first or second lateral edge.

The front face further comprises a recessed face. The recessed face is defined by a recessed top edge, a recessed bottom edge, and first and second recessed lateral edges. The front face comprises a plurality of posts. The rear face comprises a plurality of post channels to receive a respective plurality of posts of another board assembly. The bottom edge is concave.

The clip assembly comprises a docking station. The clip assembly comprises a top edge, a bottom edge, and first and second lateral edges. The clip assembly also comprises a front face having a hole, and a transparent window.

The docking assembly comprises a neck and a head. In one embodiment, the neck protrudes from a front wall. The docking assembly further comprises an adhesive rear wall, and the neck and the head comprises a hole. In an alternate embodiment, the neck protrudes from a tension arm.

The clip assembly comprises a spring assembly and a writing instrument holder.

It is therefore one of the main objects of the present invention to provide a clipboard with mounting accessories that is volumetrically efficient for use, carrying, transporting, and storage.

It is another object of this invention to provide a clipboard with mounting accessories that can be readily utilized without the need of any special tools.

It is another object of this invention to provide a clipboard with mounting accessories, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
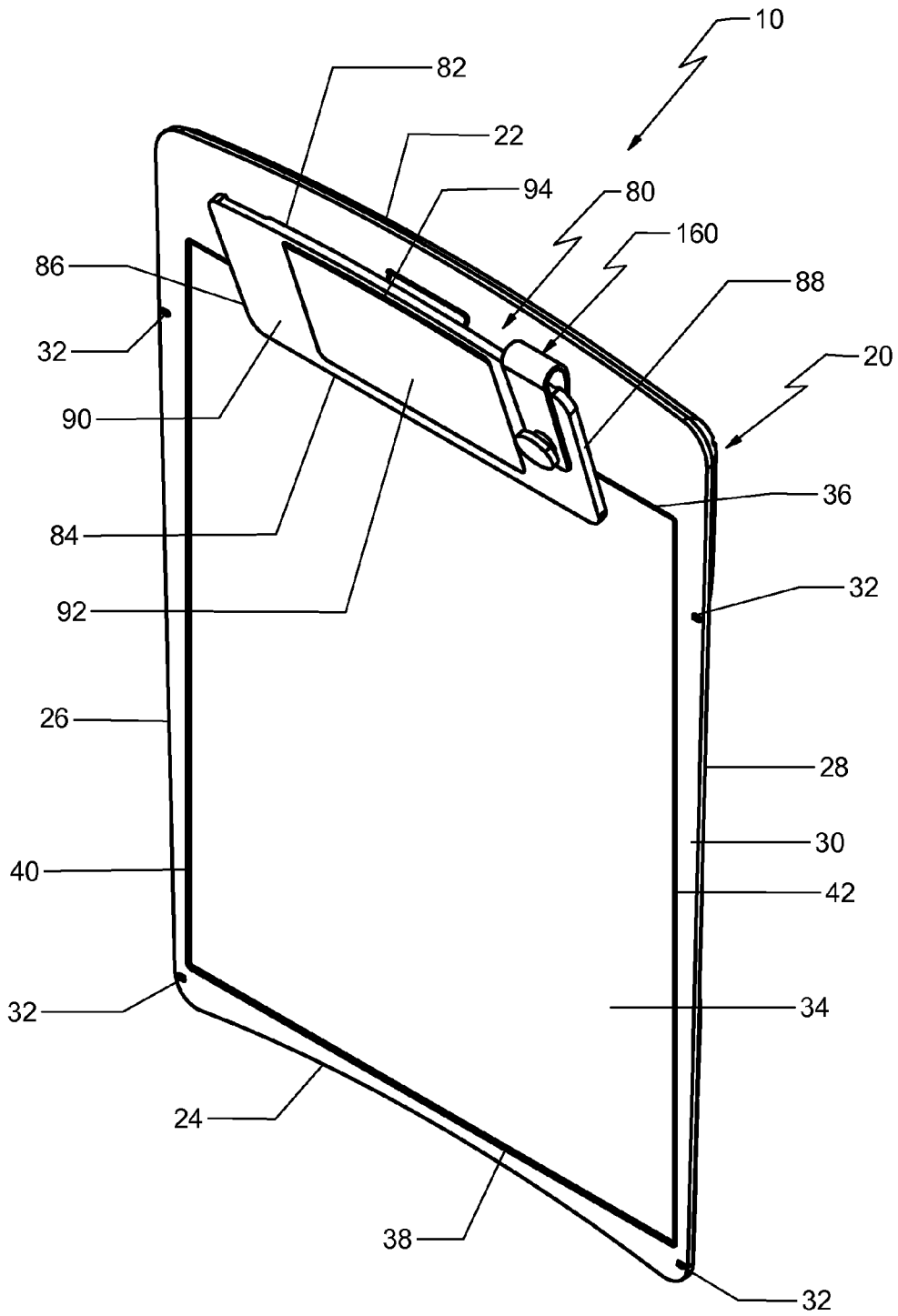
FIG. 1 is a front isometric view of the present invention.

Referring now to the drawings, the present invention is a clipboard with mounting accessories and is generally referred to with numeral 10. It can be observed that it basically includes board assembly 20, clip assembly 80, dock assembly 140, and/or dock assembly 160.

Figure 2:
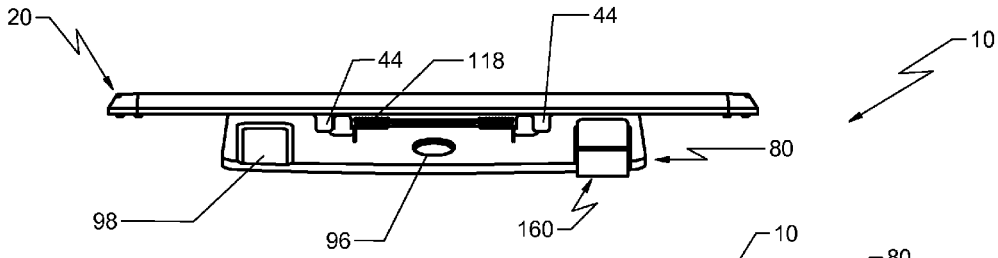
FIG. 2 is a top plan view of the present invention.
Figure 3:
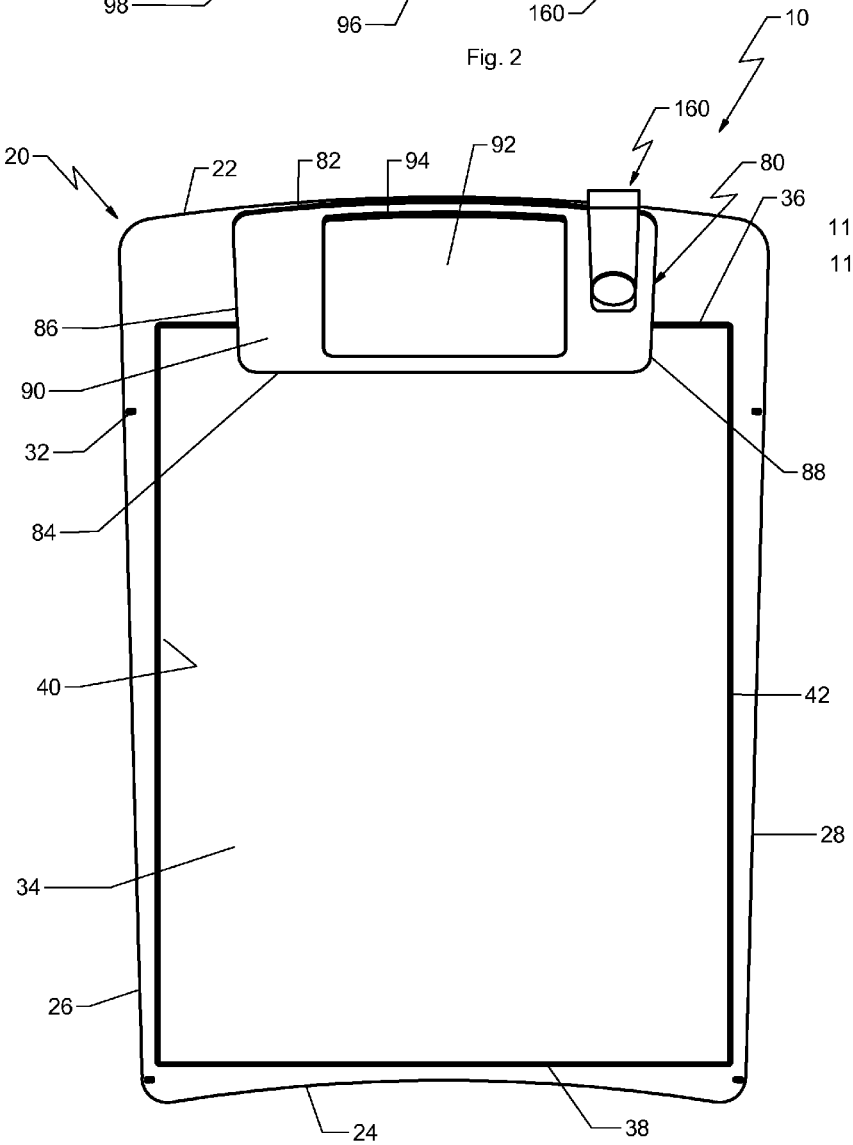
FIG. 3 is a front elevational view of the present invention.

As seen in FIGS. 1, 2, and 3, board assembly 20 comprises front face 30, defined by top edge 22, bottom edge 24, lateral edges 26 and 28, and. In a preferred embodiment, bottom edge 24 is concave, ergonomically designed to contour the leg or thigh area of a person wearing instant invention 10. Front face 30 comprises a plurality of posts 32 and recessed face 34. Protruding from front face 30 are clip assembly posts 44 for clip assembly 80 to mount thereon.

Recessed face 34 is defined by recessed top edge 36, recessed bottom edge 38, and first and second recessed lateral edges 40 and 42. Recessed face 34 can be of any size and dimension. As a first example, recessed face 34 is slightly larger than 8½ by 11 inches to accommodate letter size paper. As a second example, recessed face 34 is slightly larger than 5 by 8 inches to accommodate an alternate sized paper. As a third example, recessed face 34 is slightly larger than 3 by 3 inches to accommodate paper stationery.

Clip assembly 80 comprises front face 90 defined by top edge 82, bottom edge 84, and first and second lateral edges 86 and 88. Front face 90 has hole 96, and transparent window 92. Inserted through slit 94, a business card, not seen, may be visible through transparent window 92. Hole 96 can be used to maneuver and/or remove the business card therefrom. Clip assembly 80 further comprises docking station 98, defined as a channel to receive dock assembly 160.

Figure 4:
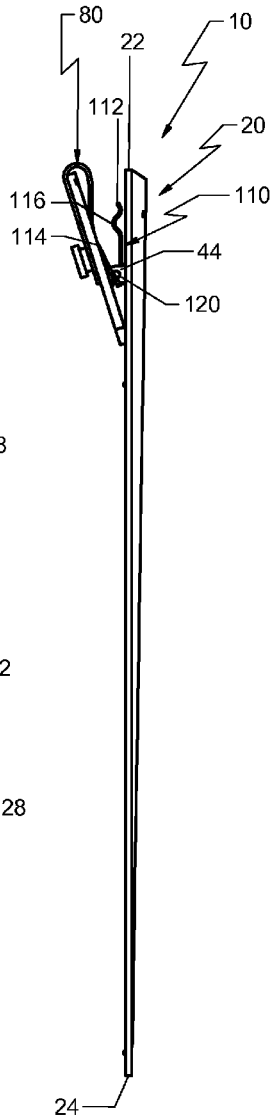
FIG. 4 is a side elevational view of the present invention.

As best seen in FIG. 4, board assembly 20 tapers from top edge 22 towards bottom edge 24. Furthermore, clip assembly 80 comprises spring assembly 110. Spring assembly 110 comprises ends 112 and 114. Between ends 112 and 114, spring assembly 110 comprises writing instrument holder 116 having a first spring force. The first spring force causes writing instrument holder 116 to be biased against front face 30. Writing instrument holder 116 may secure a pen, pencil, marker, and/or other cooperatively shaped objects in place. Spring assembly 110 also comprises coiled section 118 having a second spring force. The second spring force causes bottom edge 84 to be biased against recessed face 34. Pin 120 secures spring assembly 110 to clip assembly posts 44 for clip assembly 80 to mount thereon.

Figure 5:
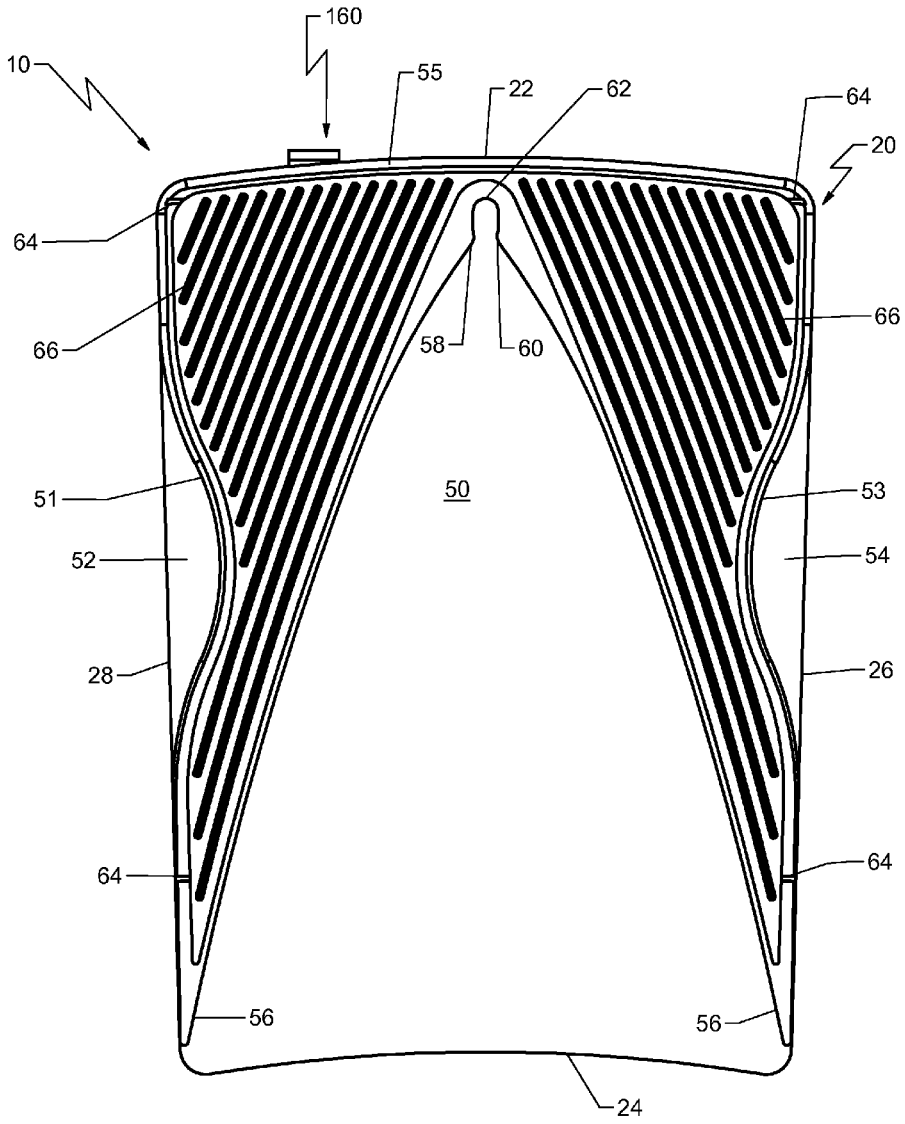
FIG. 5 is a rear elevational view of the present invention.
Figure 6:
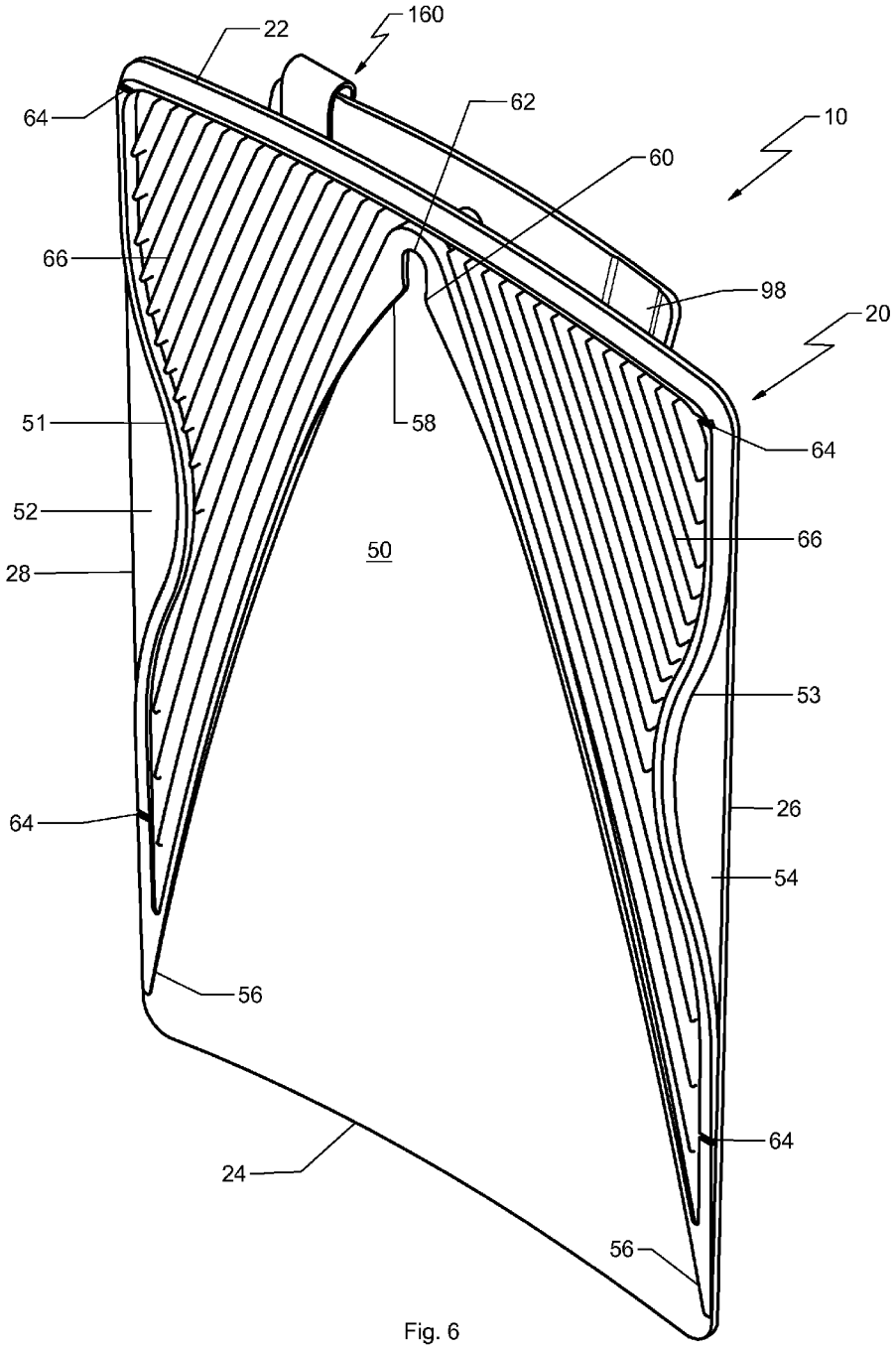
FIG. 6 is a rear isometric view of the present invention.

As seen in FIGS. 5 and 6, instant invention 10 further comprises docking means to dock board assembly 20 onto dock assembly 140 or 160. The docking means comprises first and second lower interior channel guide edges 56, and first and second higher interior channel guide edges 58 at rear face 50. The docking means further comprises first and second higher interior channel guide edges 58 terminating to forming channel neck 60, and defined at channel neck 60 is channel 62 to receive dock assembly 160. Rear face 50 further comprises at least one grip section 52 or 54 that extends from said first or second lateral edges 28 and 26 respectively. Rear face 50 further comprises fins 66, exterior top edge 55, and exterior lateral edges 51 and 53. Fins 66 provide structural integrity and stability for instant invention 10. Rear face 50 further comprises a plurality of post channels 64 to receive a respective said plurality of posts 32 of another board assembly 20 when stacking them as an example.

Figure 7:
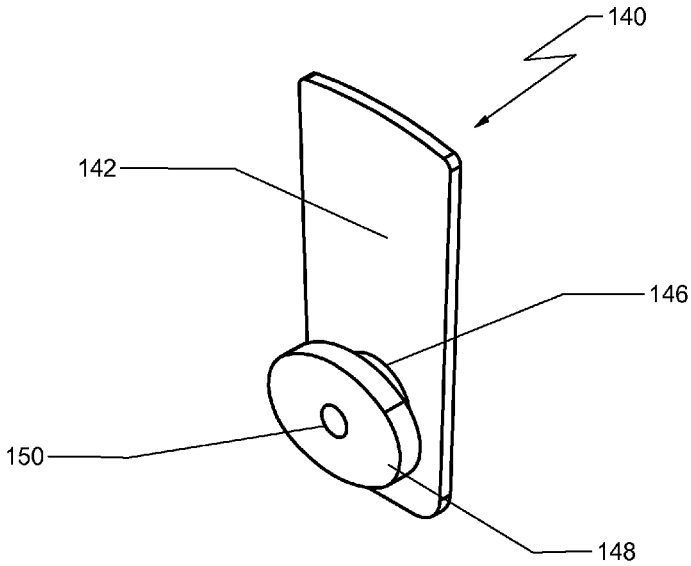
FIG. 7 is a front isometric view of a dock assembly of the present invention.
Figure 8:
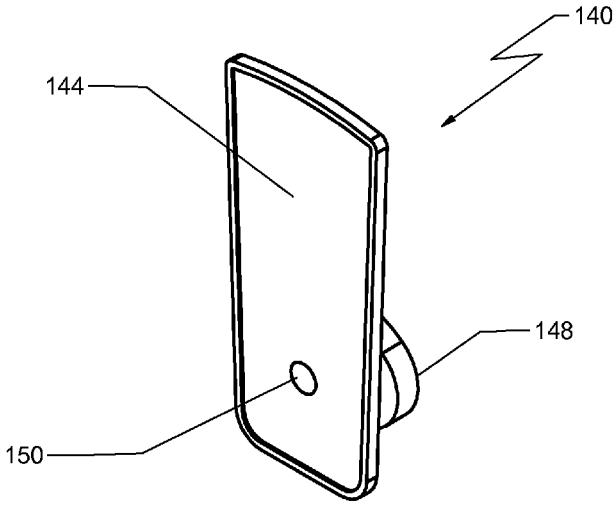
FIG. 8 is a rear isometric view of the dock assembly of the present invention.

As seen in FIGS. 7 and 8, dock assembly 140 comprises neck 146 and head 148. Neck 146 protrudes from front wall 142. Dock assembly 140 further comprises adhesive rear wall 144 and hole 150. In a preferred use, dock assembly 140 is mounted, with adhesive rear wall 144, onto any surface such as a wall or article of furniture. If desired, a screw, bolt, or other fastening means, not seen, may also be utilized through hole 150 for additional security when mounting dock assembly 140. It is noted that neck 146 and head 148 are of a cooperative shape and dimension to slide upon either first or second lower interior channel guide edges 56, first or second higher interior channel guide edges 58, channel neck 60, and finally channel 62.

Figure 9:
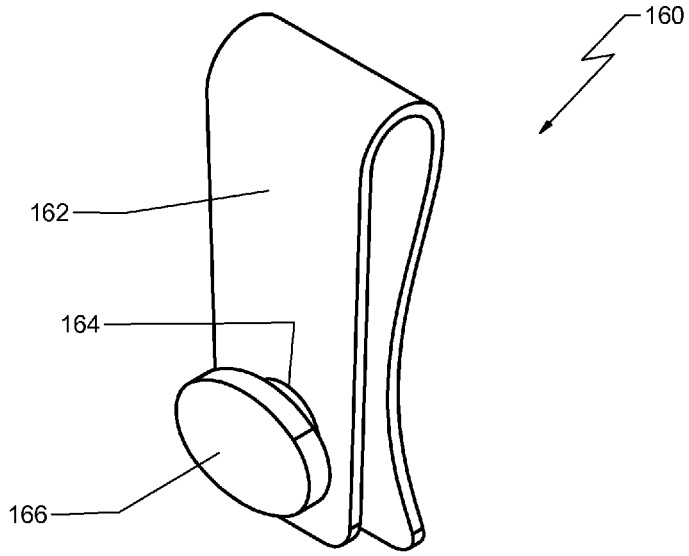
FIG. 9 is a front isometric view of an alternate embodiment dock assembly of the present invention.
Figure 10:
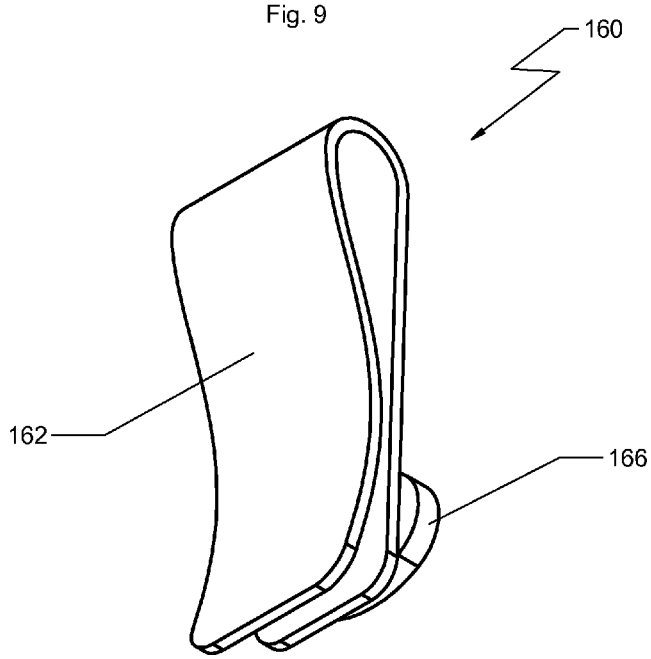
FIG. 10 is a rear isometric view of the alternate embodiment dock assembly of the present invention.

As seen in FIGS. 9 and 10, dock assembly 160 comprises neck 164 and head 166. Neck 164 protrudes from tension arm 162. In a preferred use, dock assembly 160 is mounted onto any waist band, belt, or structure able to receive tension arm 162. It is noted that neck 164 and head 166 are of a cooperative shape and dimension to slide upon either first or second lower interior channel guide edges 56, first or second higher interior channel guide edges 58, channel neck 60, and finally channel 62.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A clipboard, comprising:

A) a board assembly comprising a front face and a rear face;

B) a clip assembly mounted onto said board assembly; and

C) docking means to dock said board assembly onto a docking assembly; further characterized in that said front face is defined by a top edge, a bottom edge, and first and second lateral edges, and said rear face comprises first and second lower interior channel guide edges and first and second higher interior channel guide edges, the first lower and higher interior channel guide edges terminating near one bottom corner of the rear face, and the second lower and higher interior channel guide edges terminating near the other bottom corner of the rear face; the first and second higher interior channel guide edges terminate near the top of the rear face forming a channel neck to receive said docking assembly.

2. The clipboard set forth in claim 1, further characterized in that said board assembly tapers from said top edge towards said bottom edge.

3. The clipboard set forth in claim 1, further characterized in that said rear face further comprises at least one grip section that extends from said first or second lateral edge.

4. The clipboard set forth in claim 1, further characterized in that said front face further comprises a recessed face.

5. The clipboard set forth in claim 4, further characterized in that said recessed face is defined by a recessed top edge, a recessed bottom edge, and first and second recessed lateral edges.

6. The clipboard set forth in claim 1, further characterized in that said front face comprises a plurality of posts.

7. The clipboard set forth in claim 6, further characterized in that said rear face comprises a plurality of post channels to receive a respective said plurality of posts of another board assembly.

8. The clipboard set forth in claim 1, further characterized in that said bottom edge is concave.

9. The clipboard set forth in claim 1, further characterized in that said clip assembly comprises a docking station.

10. The clipboard set forth in claim 1, further characterized in that said clip assembly comprises a top edge, a bottom edge, and first and second lateral edges.

11. The clipboard set forth in claim 10, further characterized in that said clip assembly comprises a front face having a hole, and a transparent window.

12. The clipboard set forth in claim 1, further characterized in that said docking assembly comprises a neck and a head.

13. The clipboard set forth in claim 12, further characterized in that said neck protrudes from a front wall, said docking assembly further comprises an adhesive rear wall.

14. The clipboard set forth in claim 12, further characterized in that said neck and said head comprises a hole.

15. The clipboard set forth in claim 12, further characterized in that said neck protrudes from a tension arm.

16. The clipboard set forth in claim 1, further characterized in that said clip assembly comprises a spring assembly.

17. The clipboard set forth in claim 16, further characterized in that said spring assembly comprises a writing instrument holder.

* * * * *